US010975674B2

(12) United States Patent
Voigt et al.

(10) Patent No.: US 10,975,674 B2
(45) Date of Patent: Apr. 13, 2021

(54) USE OF NATURAL GAS FOR WELL ENHANCEMENT

(71) Applicant: STABILIS ENERGY LLC, Beaumont, TX (US)

(72) Inventors: Shawn Voigt, Aurora, CO (US); Koby Knight, Haslet, TX (US)

(73) Assignee: STABILIS ENERGY LLC, Beaumont, TX (US)

( * ) Notice: Subject to any disclaimer, the term of this patent is extended or adjusted under 35 U.S.C. 154(b) by 0 days.

(21) Appl. No.: 16/508,845

(22) Filed: Jul. 11, 2019

(65) Prior Publication Data

US 2020/0018141 A1 Jan. 16, 2020

Related U.S. Application Data

(60) Provisional application No. 62/698,350, filed on Jul. 16, 2018.

(51) Int. Cl.

| | |
|---|---|
| ***E21B 43/16*** | (2006.01) |
| ***E21B 43/25*** | (2006.01) |
| ***E21B 43/18*** | (2006.01) |

(52) U.S. Cl.

CPC ..... *E21B 43/168* (2013.01); *E21B 43/166* (2013.01); *E21B 43/18* (2013.01); *E21B 43/255* (2013.01)

(58) Field of Classification Search

CPC ..... E21B 43/16; E21B 43/166; E21B 43/25; E21B 43/255; E21B 43/26; E21B 43/267

See application file for complete search history.

(56) References Cited

U.S. PATENT DOCUMENTS

2016/0084058 A1* 3/2016 Nevison ..... E21B 43/168 166/308.1

2019/0264097 A1* 8/2019 Dusterhoft ..... E21B 43/26

* cited by examiner

*Primary Examiner* — Tara Schimpf

(74) *Attorney, Agent, or Firm* — Locklar PLLC

(57) ABSTRACT

A method for producing hydrocarbons includes the steps of a) providing a source of liquefied natural gas (LNG), b) regasifying the LNG at the well, c) pressurizing the regasified LNG above the formation pressure, d) injecting the pressurized LNG into the well, e) allowing the injection stream to flow into the producing formation, and f) recovering and transporting the regasified LNG and produced gas from the formation. The injection stream may include at least 85% methane and no more than 5 PPM water. Step f) may be carried out without separating the recovered gases. Step d) may continue for at least 24 hours. Step b) may comprise passing the LNG through a vaporizer. Step c) may be carried out before step b). An apparatus for injecting regasified LNG into a hydrocarbon formation may comprise an LNG tank, a vaporizer, a compressor, and a fluid connection to the producing formation.

12 Claims, 2 Drawing Sheets

USE OF NATURAL GAS FOR WELL ENHANCEMENT

CROSS-REFERENCE TO RELATED APPLICATIONS

This application in a nonprovisional application which claims priority from U.S. provisional application No. 62/698,350, filed Jul. 16, 2018, which is incorporated by reference herein in its entirety.

TECHNICAL FIELD/FIELD OF THE DISCLOSURE

The present invention relates generally to systems and methods to improve or enhance the flow of oil or gas from a producing field.

BACKGROUND OF THE DISCLOSURE

Oil and gas are produced from wells that penetrate subsurface hydrocarbon-bearing reservoirs. Such reservoirs are pressurized by the weight of the formations above the reservoir. When a well penetrates a formation, hydrocarbons and other fluids in the formation will tend to flow into the well because of the formation pressure. Formation fluids flow into the well as long as the pressure in the wellbore is less than the formation pressure. The flow of fluids out of the formation reduces formation pressure, however, and production eventually slows or ceases. Gas and oil fields may experience reduced production over time due to a drop in formation pressure and/or accumulation of liquids in the well(s). Liquids flowing into the well, which can include water and/or hydrocarbons, may clog the fissures, lower field pressure and increase viscosity, which in turn may degrade the flow of gas, oil and other products to wells in that field.

To extract more hydrocarbons from a well, various production-enhancing techniques can be used. Secondary recovery methods generally include injecting water or gas to displace oil and driving the hydrocarbon mixture to a production wellbore, which results in the enhanced recovery of 20 to 40 percent of the original oil in place. After a reservoir has been flooded with water or other secondary recovery methods, tertiary recovery methods may be used to increase the fluid recovery from the reservoir. In some cases, tertiary recovery methods may be used immediately after the primary recovery method.

Tertiary recovery methods often include the injection of steam, gas, and/or chemicals. Gas injection tertiary methods may use gases such as natural gas, nitrogen, or carbon dioxide that expand in a reservoir to push additional hydrocarbons to a production wellbore. In gas injection, the injected fluids are traditionally at temperatures greater than −100° F. Commonly-used gases are those that dissolve in the reservoir hydrocarbons, thereby lowering the viscosity and improving the flow rate of the reservoir hydrocarbons to the production well.

SUMMARY

In some embodiments, regasified natural gas may be injected into a formation via one or more injection wells. The dry natural gas flows through the field absorbing liquids, increasing field pressure and lowering viscosity of liquids in the field. The wet natural gas can be produced through producing wells and enter a natural gas sales line without additional processing other than the processing normally associated with that field. The resulting reduction of liquids in the formation enhances the flow of other components such as oil and natural gas liquids (NGLs) through the formation and ultimately into the well.

Liquid Natural Gas (LNG) is suitable for hydrocarbon production enhancement, as natural gas must be dehydrated to be liquefied. Compressed Natural Gas (CNG) or other forms of natural gas may also be utilized if the CNG and other forms of natural gas are sufficiently dehydrated before being injected. Prior to injection, the natural gas may be heated to near ambient surface conditions or may be heated to several hundred degrees or more to increase the efficiency of the process of recovery. In other embodiments, LNG may be pumped into a well without vaporization; when LNG is pumped into the well without vaporization, the well being utilized may be protected from the cryogenic temperatures of the LNG.

Liquefied natural gas is a liquid substance, a mixture of light hydrocarbons primarily composed of methane (85-98% by volume), with smaller quantities of ethane, propane, higher hydrocarbons ($C_{4+}$) and nitrogen as an inert component. The composition of LNG depends on the traits of the natural gas source and the treatment of gas at the liquefaction facility, i.e. the liquefaction pre-treatment and the liquefaction process. The composition of the LNG can also vary with storage conditions and customer requirements.

In some embodiments, a method for producing hydrocarbons from a well drilled into a producing formation may include a) providing a source of LNG at the well, b) regasifying the LNG at the well, c) pressurizing the regasified LNG to a pressure above the pressure in the producing formation, d) injecting an injection stream comprising the pressurized regasified LNG into the well, e) allowing the injection stream to flow into producing formation, and f) recovering the regasified LNG along with produced gas from the formation and transmitting both in a gas pipeline. The regasified LNG and/or the injection stream may each include at least 85% methane or at least 98% methane and may include no more than 5 PPM water. Step f) may be carried out without separating the recovered gases. Step e) may include injecting the injection stream for at least 24 hours.

Step a) may include transporting a tank of LNG to the well using a transport vehicle, wherein the transport vehicle also transports a regasifier for use in step b). The method may further include the step of transporting the tank of LNG to a second well using the transport vehicle and implementing steps b)-f) at the second well.

The method may further include providing a regasifier at the well. Step b) may include passing the LNG through a vaporizer to produce a regasified LNG stream and may include using heat from ambient air, electric heat, or heat from combusting a fuel. Step c) may include passing the regasified LNG stream through a compressor to produce a pressurized regasified LNG stream. Step c) may be carried out before step b).

In some embodiments, an apparatus for treating a hydrocarbon-producing well having a producing formation may include a tank of liquefied natural gas (LNG), a vaporizer for regasifying the LNG, a compressor for pressurizing the regasified LNG to a pressure above the pressure in the producing formation, and a fluid connection for injecting an injection gas stream comprising the pressurized regasified LNG into the producing formation.

DETAILED DESCRIPTION

Figure 1:
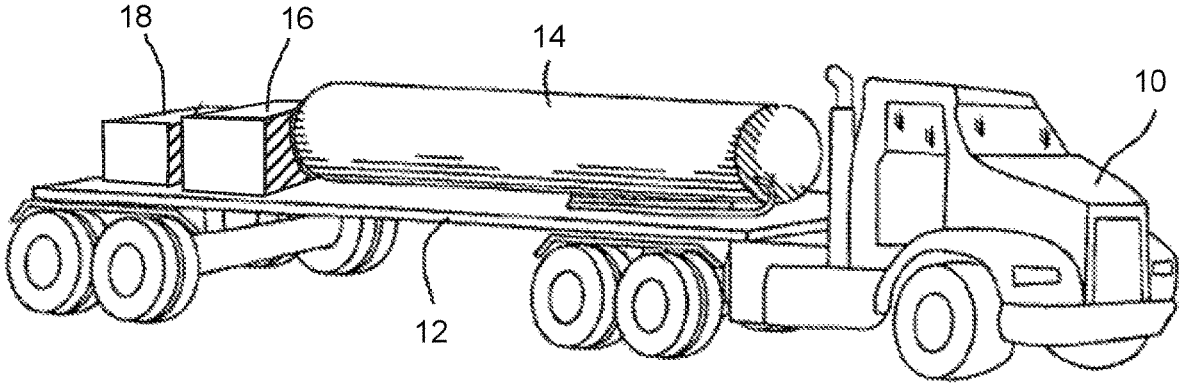
FIG. 1 is a schematic view of a transportation system that can be used in accordance with certain embodiments of the invention.

It is to be understood that the following disclosure provides different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Natural gas may be transported by pipeline from the gas fields where it is produced to a liquefaction facility. The operators of liquefaction plants may desire to ensure that the LNG has a consistent composition and combustion characteristics. LNG plants achieve the desired LNG properties by cooling and condensing the natural gas. Once liquefied, the LNG can be loaded into tanks for delivery to the end use.

The processes for removing undesired components from natural gas to obtain gas that is acceptable for liquefaction are performed in preparation trains. Preparation trains may remove the following components prior to liquefaction: components that would freeze at cryogenic process temperatures during liquefaction, including carbon dioxide ($CO_2$), water and heavy hydrocarbons, components that must be removed to meet the LNG product specifications, including hydrogen Sulfide ($H_2S$), corrosive and erosive components such as mercury, inert components such as helium and nitrogen, and oil. A typical specification of gas for liquefaction may require less than 1 ppm of water, less than 100 ppm $CO_2$, and less than 4 ppm $H_2S$.

After the natural gas feedstock has been prepared for liquefaction, it may be fed into a liquefaction module. In the liquefaction module, the natural gas is cooled to −240° to −260° F. (−151° C. to −162° C.), at which temperature the vapor pressure is close to 1 atm (101 kPa). Liquefaction systems entail sequentially passing the gas at an elevated pressure through a plurality of cooling stages in which the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants.

The liquefaction process may remove all non-hydrocarbon contaminates ($CO_2$, dirt, oil, water) from the natural gas, providing an ultraclean form of gas. In some instances, $C_{2+}$ hydrocarbons that condense during the liquefaction process are allowed to remain in the LNG product. In other instances, and typically in commercial LNG processes in the United States, $C_{2+}$ hydrocarbons are removed during the liquefaction process, so that the resulting LNG typically includes at least 95% methane and more typically includes at least about 98% methane. Either form of LNG may be used in the present process and the term LNG is used herein to refer to either.

Figure 2:
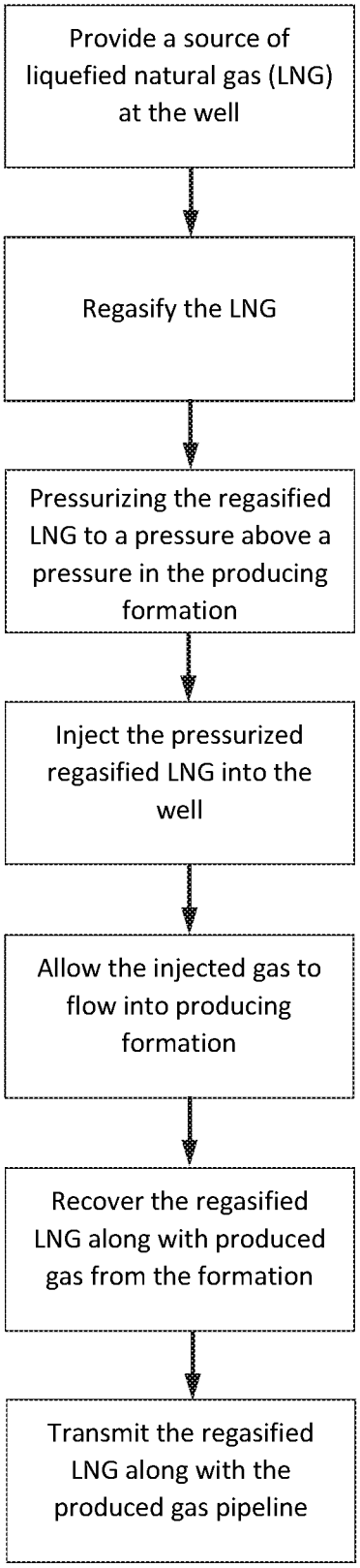
FIG. 2 is a flow chart showing steps that may be carried out in certain embodiments of the invention.

Referring now to FIG. 2, the resulting LNG may be used to enhance production according to the following steps.

In some embodiments, the LNG may be placed in a reusable storage tank. The tank may be used to transport the LNG to a desired usage location. In some cases, the LNG may be transported to a hydrocarbon production site, also referred to as a wellsite. The transport of LNG to the well may be carried out using a transport vehicle such as a truck. The transport vehicle may also transport a regasifier, vaporizer, and/or compressor to the well. The tank, regasifier, vaporizer, and/or compressor may form a system that may be transported from one well to another, providing LNG for injection at each well as-needed. By way of example, the LNG tank truck that delivers LNG to the wellsite may include a trailer on which regasification equipment is mounted. By way of example only and as illustrated in the Figure, a tractor 10 and trailer 12 may transport an LNG tank 14, a regasifier 16, and a compressor 18 to a well that is to be treated and from one well to another.

In some instances, storage and transportation of LNG may be governed by regulations, including but not limited to, in the United States, 49 C.F.R. §§ 193 and 178 and in particular, Specification MC-338, which governs insulated cargo tank motor vehicles. In such instances, equipment and personnel qualifications may be specified.

Once at the wellsite, the LNG may be fed to a vaporizer and then to a compressor, which may or may not be on a transport vehicle as shown in the drawing. Alternatively, the LNG may be sent to a high-pressure pump and then to a vaporizer. In either case, the output may comprise gas at a pressure slightly above the well casing pressure, which may be 150 to 4500 psig (1,030 to 31,025 kPa) and at a temperature in the range of 150 to 200° F. (65 to 95° C.). In some embodiments, the output pressure may be about 10% higher than the formation pressure. Heat for regasifying (vaporizing) the LNG may be provided from any suitable source, including but not limited to, ambient air, combustion of gas or other fuel, electric heating, or any other heat source.

The resulting gas stream comprising pressurized regasified LNG may be injected into a desired subsurface formation via one or more injection wells. Injection may be at a desired rate and make take place over a period time. In some instances, injection may be performed so as to inject a desired volume of regasified gas.

As mentioned above, an LNG tanker (vehicle) may include regasification equipment. Because the rate at which the regasified LNG is injected is relatively low, the regasification equipment can be sized accordingly. In other instances, a regasification plant may be installed permanently or semi-permanently at a wellsite.

The regasified LNG may have a water content of less than about 5 PPM and in some instances less than about 1 PPM. It has been discovered that this dry unsaturated gas has the ability to take up other hydrocarbons and is effective for enhancing production. Wells into which regasified LNG has been injected have seen production rise dramatically, in some cases as much as 20% or more. In some instances, production begins to increase within 24 hours.

By way of example only, regasified LNG was injected into a well that had been producing less than one barrel per hour of oil. The regasified LNG was injected at a rate of 18000 SCFH for 24 hours, after which production was resumed. Without additional intervention, production of oil from the well rose to 43 barrels/day following the LNG injection.

The following table gives production data for an exemplary well in which well enhancement using injected LNG began on Day 3. As can be seen, production increased rapidly and significantly.

| Day # | Oil Prod (barrels) | Gas Prod (barrels) |
|---|---|---|
| 1 | 0 | 0 |
| 2 | 0 | 0 |
| 3 | 0 | 0 |
| 4 | 8.73 | 8.13 |
| 5 | 39.53 | 36.71 |
| 6 | 43.63 | 37.11 |
| 7 | 41.42 | 40.86 |
| 8 | 38.09 | 38.97 |
| 9 | 40.74 | 45.6 |
| 10 | 36.17 | 40.88 |
| 11 | 36.57 | 33.94 |
| 12 | 40.37 | 43.77 |
| 13 | 42.64 | 42.78 |
| 14 | 40.37 | 42.3 |
| 15 | 39.1 | 39.2 |
| 16 | 38.65 | 35.48 |
| 17 | 40.04 | 40.54 |
| 18 | 43.39 | 38 |
| 19 | 39.2 | 35.85 |
| 20 | 37.25 | 38.41 |

Once it has returned to the surface, the pressurized, regasified natural gas that was injected into the well can be separated from the produced liquids and sent to a gas production line for transmission to a gas processing facility, instead of to a flare or vent stack. Because LNG is cleaner than produced gas, in some instances, the lift gas returning to the surface may be fed directly into production lines with only minimal standard processing and, in some embodiments, without undergoing gas separation. Likewise, since LNG is cleaner than pipeline gas, the gas returning to the surface often requires no further processing for sales. In some embodiments, the standard processing may include separation of produced gases from produced liquids, such as by passage through one or more vapor-liquid separators such as a flash drum, breakpot, knock-out drum or knock-out pot, compressor suction drum or compressor inlet drum.

Because of its compressed nature, a large amount of gas for use in the present method can be delivered to a well as LNG. Thus, the present process can operate for an extended period of time, unmanned, without violating emission regulations or permits. Similarly, the equipment required to operate the present process is more compact and can operate on well sites whose size or location restrict access by traditional methods. Well gases including $CO_2$, NGLs and methane are all greenhouse gases. Because storage and/or cleanup may be impractical in some instances, gas that does not meet the pipeline specification may need to be flared. Traditional processes may cause these to be emitted to atmosphere, which can violate air permits. The present process reduces undesired emissions to nearly zero.

In other embodiments, the LNG can be injected into the well without regasification. If injected as a cryogenic fluid, the LNG may fracture the formation as it warms, thereby opening new fluid flow paths. As the injected fluid warms and flows through the formation, a front of liquid natural gas may form near the wellbore. In some cases, it may be desired to produce hydrocarbons and recover injected fluids from one or more adjacent wells that are fluidly connected to the injection well via the producing formation. In some cases, it may be desired to inject fluids for a period of time and then to cease injecting and produce hydrocarbons and recover injected fluids from the same well or wells that were used to inject the fluids.

The foregoing outlines features of several embodiments so that a person of ordinary skill in the art may better understand the aspects of the present disclosure. Such features may be replaced by any one of numerous equivalent alternatives, only some of which are disclosed herein. Likewise, unless expressly stated, the sequential recitation of steps in the claims that follow is not intended as a requirement that the steps be performed in the sequence recited.

One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A method for producing hydrocarbons from a production well drilled into a producing formation, the method comprising the steps of:

a) providing a source of liquefied natural gas (LNG) at an injection well;

b) regasifying the LNG at the injection well;

c) pressurizing the regasified LNG to a pressure above the pressure in the producing formation;

d) injecting an injection stream comprising the pressurized regasified LNG into the injection well;

e) allowing the injection stream to flow into producing formation; and f) recovering the regasified LNG along with produced gas from the formation at the production well and transmitting both in a gas pipeline.

2. The method of claim 1 wherein step f) is carried out without separating the recovered gases.

3. The method of claim 1 wherein step e) comprises injecting the injection stream for at least 24 hours.

4. The method of claim 1 wherein step a) comprises transporting a tank of LNG to the well using a transport vehicle, wherein the transport vehicle also transports a regasifier for use in step b).

5. The method of claim 4, further including the step of transporting the tank of LNG to a second injection well using the transport vehicle and implementing steps b)-f) at the second well.

6. The method of claim 1 wherein step c) comprises passing the regasified LNG stream through a compressor to produce a pressurized regasified LNG stream.

7. The method of claim 1 wherein step b) is carried out before step c).

8. The method of claim 1 wherein the injection stream comprises at least 85% methane.

9. The method of claim 1 wherein the injection stream comprises at least 98% methane.

10. The method of claim 1 wherein the injection stream comprises no more than 5 PPM water.

11. The method of claim 1 wherein step b) includes using heat from ambient air, electric heat or heat from combusting a fuel.

12. The method of claim 1 wherein step a) comprises transporting an LNG tank on a truck.

* * * * *